United States Patent [19]

Semons

[11] Patent Number: 5,067,207

[45] Date of Patent: Nov. 26, 1991

[54] ZIPPER ATTACHMENT ASSEMBLY

[76] Inventor: William Semons, 14 Highland Ave., Salem, Mass. 01970

[21] Appl. No.: 563,349

[22] Filed: Aug. 7, 1990

[51] Int. Cl.[5] ..... A44B 19/00

[52] U.S. Cl. ..... 24/381; 24/387; 24/419; 135/115

[58] Field of Search ..... 24/381, 383, 385, 387, 24/405, 410, 411, 419, 422, 429; 135/115; 5/97

[56] References Cited

U.S. PATENT DOCUMENTS

| | | | |
|---|---|---|---|
| Re. 19,128 | 4/1934 | Drew . | |
| Re. 28,969 | 9/1976 | Naito . | |
| 1,732,878 | 10/1929 | Collender | 135/115 |
| 2,114,683 | 4/1938 | Kates | 24/381 |
| 2,122,681 | 7/1938 | Dykes . | |
| 2,382,930 | 8/1945 | Williams . | |
| 2,408,688 | 10/1946 | Schonthal | 24/387 |
| 2,483,604 | 10/1949 | Abramson . | |
| 2,550,000 | 4/1951 | Brady . | |
| 2,638,650 | 5/1953 | Breier | 24/410 |
| 2,768,922 | 10/1956 | Klein . | |
| 2,978,769 | 4/1961 | Harrah . | |
| 3,006,793 | 10/1961 | Wheeler . | |
| 3,346,883 | 10/1967 | Ersek . | |
| 3,518,991 | 7/1970 | Goss | 24/381 |
| 3,546,721 | 12/1970 | Cleary . | |
| 3,547,136 | 12/1970 | Prinz | 135/115 |
| 3,685,103 | 8/1972 | Severino | 24/381 |
| 3,785,014 | 1/1974 | Canepa | 24/381 |
| 3,785,614 | 1/1974 | Enomoto . | |
| 3,948,705 | 4/1976 | Ausnit . | |
| 4,341,575 | 7/1982 | Herz . | |
| 4,354,541 | 10/1982 | Tilman . | |
| 4,561,109 | 12/1985 | Herrington . | |
| 4,691,373 | 9/1987 | Ausnit . | |
| 4,703,518 | 10/1987 | Ausnit . | |
| 4,881,546 | 11/1989 | Kaessmann | 24/381 |

FOREIGN PATENT DOCUMENTS

| | | | |
|---|---|---|---|
| 717622 | 10/1954 | United Kingdom | 24/419 |

*Primary Examiner*—Victor N. Sakran
*Attorney, Agent, or Firm*—Terry M. Gernstein

[57] ABSTRACT

A zipper assembly can be mounted on a cover, such as tarpaulin, or the like, and an opening through the cover defined beneath the zipper assembly to permit movement through the opening while also permitting the opening to be sealed as necessary. The opening can be large enough to permit a motor vehicle to be driven through the cover, as in a situation where a cover is used to close a building access door, or the opening can be sized to permit a person to move through the cover.

6 Claims, 2 Drawing Sheets

ZIPPER ATTACHMENT ASSEMBLY

TECHNICAL FIELD OF THE INVENTION

The present invention relates to the general art of closures, and to the particular field of reusable closures.

BACKGROUND OF THE INVENTION

Many different items are covered by tarpaulins or the like to protect such items and devices from damage. An automobile is one common example of such covered items. A tarpaulin or other such covering item is placed over an automobile to protect the automobile from damage from exposure to the sun, to dirt, or the like. Other examples of such covered items include boats, construction, agricultural equipment and any sort of land, marine or air vehicle. Even some aircraft are often simply covered instead of placing such aircraft in a hanger.

Building openings are also often closed by placing a covering over such opening. A cargo access opening to either a building or to a vehicle can be covered in this manner.

While quite helpful and advantageous, such coverings have several drawbacks which inhibit the full commercial success thereof.

One problem is associated with the secure nature of the covering item itself. Once in place, many covering elements do not permit easy or expeditious access to the covered item. For example, if a boat is covered, ingress to the boat, or egress from the boat is severely inhibited, if not totally prevented by the cover. This is also a problem if a cover is used to close an access opening to a building. Traffic, both vehicular and personnel, cannot easily pass through the cover without endangering the integrity of the cover closure.

Furthermore, if a cover is used to prevent access of personnel, locks must be provided. While some covers can be strong enough to prevent unauthorized access to a building when sealed to the building, it is not always easy to maintain this secure feature if traffic through the access opening is also permitted.

Often, the cover is designed to fit snugly and securely about the item being protected and such design feature can be vitiated by the need for access to the covered item. For example, repeatedly lifting and replacing a cover from and to a covered item may weaken, or even destroy, the attaching features associated therewith.

Therefore, there is a need for an element which can be used in conjunction with a covering element to permit that covering element to securely and snugly cover an item yet will still permit easy and expeditious access through the cover without vitiating the covering feature thereof, and which can be used in association with a wide variety of different covering elements.

OBJECTS OF THE INVENTION

It is a main object of the present invention is to provide an element which can be used in conjunction with a covering element to permit that covering element to securely and snugly cover an item.

It is a another object of the present invention to provide an element which can be used in conjunction with a covering element to permit that covering element to securely and snugly cover an item yet will still permit easy and expeditious access through the cover without vitiating the covering feature thereof.

It is another object of the present invention to provide an element which can be used in conjunction with a covering element to permit that covering element to securely and snugly cover an item yet will still permit easy and expeditious access through the cover without vitiating the covering feature thereof, and which can be used in association with a wide variety of different covering elements.

It is another object of the present invention to provide a covering element that can be used to lockably cover a building access opening or an object while still permitting authorized access to that building object.

SUMMARY OF THE INVENTION

These, and other, objects are achieved by a unitary zipper attachment which includes a monolithic, one-piece base having a zipper mechanism secured thereto with the base completely surrounding the zipper mechanism.

By being completely surrounded by a monolithic, one-piece base, the zipper mechanism can be used on large items, such as covers used to cover a boat, airplane, car, or the like and can also be used on covers used to close access doors to buildings, cargo vehicles and the like. The cover can thus have an access opening defined therein that is large enough to accommodate a person walking through the opening, or even be large enough to permit a vehicle to be driven through the opening. The opening can then be re-closed and re-opened as often as desired without vitiating the secure and snug nature of the fit between the cover and the supporting surfaces.

An access hole can be defined through the cover in any suitable location, at any suitable orientation and in any suitable size for the most advantageous use of the cover, with the hole being openable and closable as many times as necessary. The access hole can be as large or as small as desired to achieve the purposes of the cover as determined by the user.

The zipper attachment assembly, being monolithic and one-piece, is extremely strong and thus can be repeatedly used in conjunction with such large openings while still providing a secure seal when closed so the basic integrity of the cover will not be nullified of endangered. The zipper element also can be operated from either side and can include locking elements so that element can be locked from one side, for example from the inside of a building.

The assembly of the present invention further includes adhesive on a base so the assembly can easily and expeditiously be mounted on a cover. The assembly further includes a protective cover that is releasably held on the base by the adhesive. The protective cover is also monolithic and one-piece so it can be easily removed. This is an especially attractive feature for large assemblies, such as might be used on a building cargo access door where the zipper assembly must be large, yet capable of being easily mounted on the cover.

BRIEF DESCRIPTION OF THE DRAWING FIGURES

FIG. 1 is a perspective view of a cover that is suitable for use as a protective element foir a vehicle or for covering a building access opening, or the like.

DETAILED DESCRIPTION OF THE PREFERRED EMBODIMENT OF THE INVENTION

Figure 1:
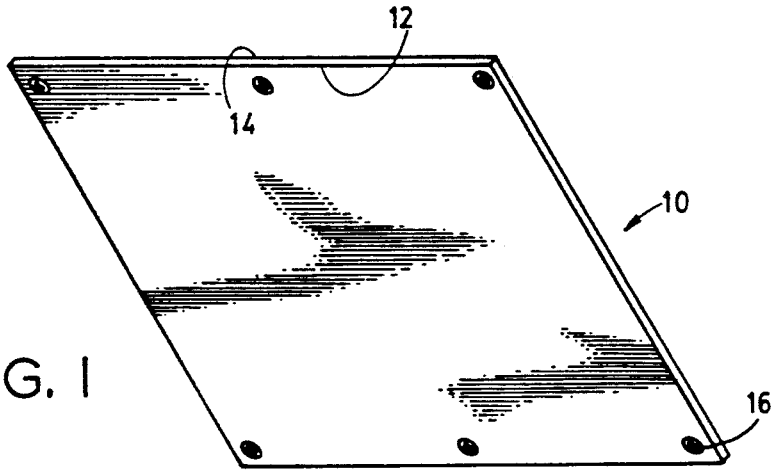

Shown in FIG. 1 is a cover, such as tarpaulin 10, that is suitable for use in covering a vehicle, such as a boat, a car, an airplane or the like. The cover can be formed of any suitable material and is shown as being polygonal in shape, but can be any suitable shape. The cover 10 includes a top surface 12 and a bottom surface 14 which could be an inside surface and an outside surface in the case of a building. The cover can be attached to a building or other suitable support surface using fastener holes, such as hole 16 and will securely cover the item or area of interest.

Figure 2:
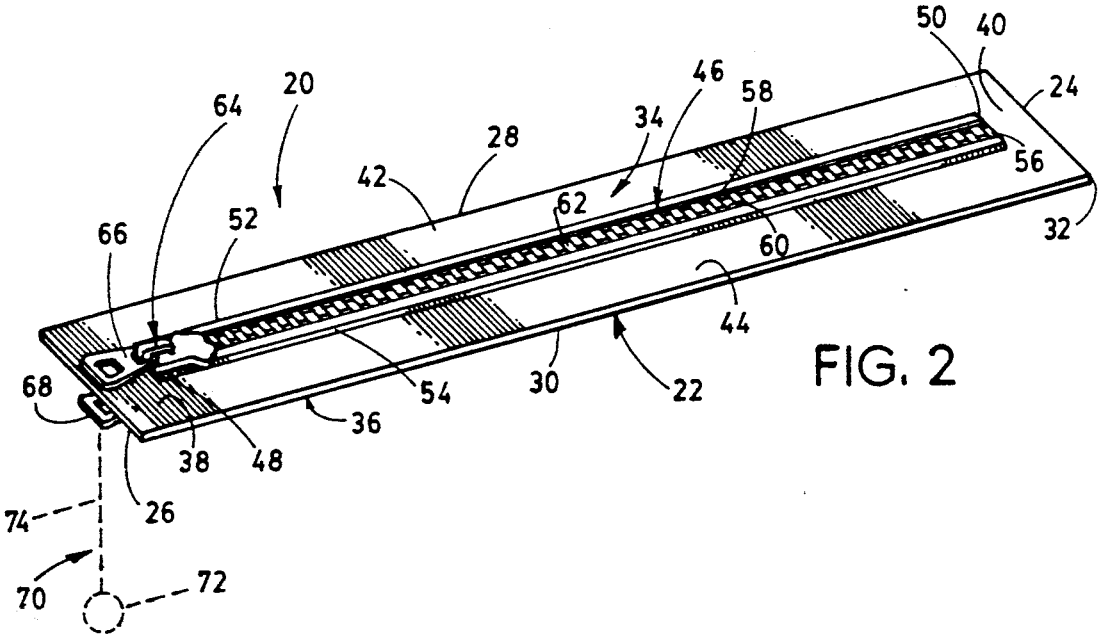
FIG. 2 is a perspective view of a zipper attachment assembly embodying the present invention.

In order to provide access through the cover 10, the present invention provides a zipper attachment assembly 20, best shown in FIG. 2. The zipper attachment assembly is as small or as large as required, and can be large enough to permit a vehicle, even a large cargo semitrailer truck, to pass through an opening defined through the cover, while permitting the opening to be re-closed in a secure manner.

The zipper attachment 20 includes a monolithic, one-piece base 22 that is polygonal in outer peripheral shape and has two ends 24 and 26, and two sides 28 and 30 which intersect to form corners, such as corner 32. The base has a width dimension defined between the sides and a length dimension defined between the ends, a front surface 34 and a back surface 36. The front surface is defined with reference to a cover on which the assembly 20 will be mounted as will be understood from the ensuing discussion.

An opening is defined though the base 22 and extends along the length dimension of the base from adjacent to and spaced from one end edge 26 to adjacent to and spaced from the other end edge 24 and has sides that extend along and spaced from the base side edges 28 and 30 respectively. The opening is sized to be large enough to accommodate any item or person that is expected to pass through the cover 10. For example, if the cover is to be used to cover an access opening into a cargo building, the opening through the zipper base should be large enough so that, when it is open, a person or a cargo vehicle can pass through the zipper attachment assembly 20 via the opening. The opening is polygonal and, is the preferred form of the invention, is square or rectangular.

By being spaced from the base side and end edges, the opening has a border completely surrounding it. This border includes a first end area 38 adjacent base end 26, a second end area 40 adjacent to base end 24, a first side area 42 adjacent to base side 28 and a second side area 44 adjacent to the base second side 30. The border is monolithic and one-piece and thus adds strength to the assembly so that when the assembly is used in conjunction with a large hole in the cover 10, the assembly is not likely to tear around that hole.

A zipper mechanism 46 is securely attached to the base 22 adjacent to the opening through that base and is completely surrounded by the border of the base. The zipper mechanism includes a first zipper end 48 adjacent to the first base border end area 38, a second zipper end 50 adjacent to the second border end area 40, a first zipper side 52 adjacent to the base border first side area 42 and a second zipper side 54 adjacent to the base border second side area 44. The zipper mechanism is attached to the base adjacent to the border areas so that the zipper mechanism sides and ends are spaced from the corresponding sides and ends of the base. Thus, the border surrounding the zipper mechanism on all peripheral edges thereof is monolithic and one-piece so that strength of the mechanism is assured.

The zipper mechanism 46 includes a bottom end-piece 56 that acts as a bottom stop for the zipper and has two sets of chains 58 and 60, each of which includes zipper teeth, such as tooth 62, attached to the base border. The teeth in one chain mate with corresponding teeth in the other chain to close the zipper mechanism and are released from such mating engagement by means of a slide 64 that is operated by pulling on pull tabs 66 or 68 in the manner usual to zipper operation. Each zipper mechanism chain also has a top-end piece 70 located adjacent to the end 48 to act as a top stop for the slide.

The zipper mechanism can be a two-way zipper which can be openend from either end thereof if so desired.

Figure 3:
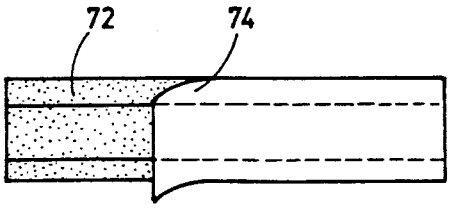
FIG. 3 is a rear elevational view of the zipper attachment assembly of the present invention, showing a protective cover element partially peeled off and uncovering adhesive on the back of the assembly.
Figure 4:
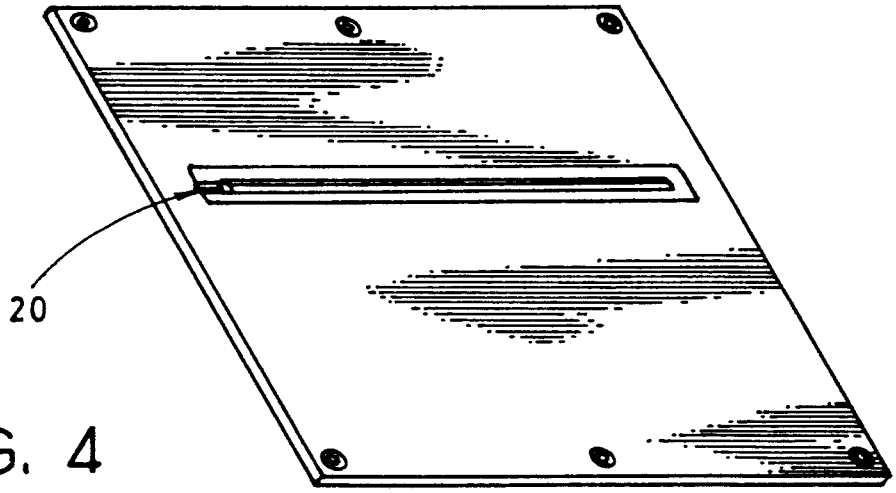
FIG. 4 is a perspective view of the FIG. 1 cover having the zipper attachment mounted thereon.

As is best shown in FIG. 3, the base back 36 is covered with adhesive material 72 which will adhere to the cover 10 when applied to a surface thereof. For the sake of convenience, the cover surface to which the zipper adhesive is applied will be referred to as the top surface of the cover. The adhesive 72 covers the entire area of the back surface, and the mechanism includes a protective cover 74 that is releasably held on the back surface of the base by the adhesive. The protective cover is simply removed prior to applying the zipper mechanism to the cover 10, and the zipper mechanism is applied to the cover at the suitable location and in the suitable orientation so the adhesive 72 secures the zipper mechanism in place on the cover. The zipper mechanism is shown in FIG. 4 as being applied to the cover 10.

Figure 5:
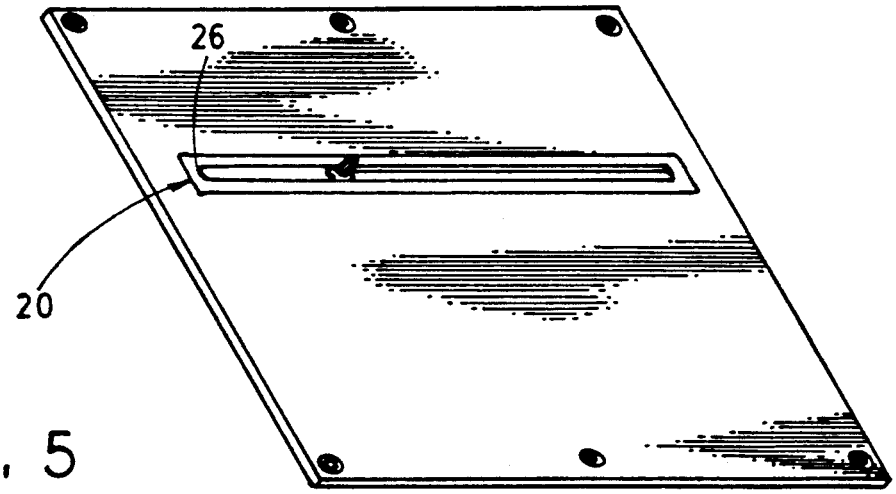
FIG. 5 is a perspective view similar to FIG. 4, but with the zipper attachment partially open.

The zipper slide 64 is then operated to open the zipper by pulling the slide 64 all the way down from the top end as shown in FIG. 2 to the bottom end 56. This operation will expose the cover beneath the zipper mechanism, and this exposed cover is then simply cut with a knife or the like to open a hole through the cover. the base 22 will also be slit by the knife as it is used to define the hole through the cover. The zipper slide is then operated by pulling the slide back into the FIG. 2 position to close that open hole. The zipper mechanism can be operated from either side of the cover 10 using the pull tabs 66 and 68. This operation is indicated in FIG. 5 where the zipper is shown to be partially drawn from the end 48. End stops 76 are also indicated in FIG. 5.

As shown in FIG. 2, the zipper mechanism also includes lock assembly 70 which permits the zipper assembly to be locked. This feature is especially useful if the assembly is used on a cover for a building access opening. Using the lock asembly 70, the access opening of a building can be locked in the manner of other doors by simply closing the zipper and attaching a pull ring 72 to a lock element located inside the building. A chain 74 connects the pull ring to the zipper pull tab 68 so the zipper cannot be operated. The tab 68 will be on the inside of the building and the tab 66 will be located on the outside of the building. When the tab 68 is unlocked, the zipper can be operated from either inside or outside of the building.

It is understood that while certain forms of the present invention have been illustrated and described herein, it is not to be limited to the specific forms or arrangements of parts described and shown.

I claim:

1. A unitary zipper attachment assembly comprising:

A) a monolithic one-piece base having two outside end edges, two outside side edges, a front surface and a back surface;

B) a zipper mechanism mounted on said base front surface adjacent to and spaced from both of said outside side edges and adjacent to and spaced from both of said outside end edges to be completely surrounded by said base, said base having a monolithic border completely surrounding said zipper mechanism, said zipper mechanism having a first end located adjacent to and spaced from a first outside end edge of said base end edges, a second end located adjacent to and spaced from a second outside end edge of said base end edges, a first side located adjacent to and spaced from one outside side edge of said base side edges, a second side located adjacent to and spaced from a second outside side edge of said base side edges, a first end piece on said zipper mechanism first end, and a second end piece on said zipper mechanism second end;

C) zipper side elements attaching said zipper mechanism to said base front surface and spacing said zipper mechanism from said base;

D) adhesive material on said base back surface and covering essentially the entire base back surface;

E) a monolithic, uninterrupted one-piece protective cover releasably attached to said base back surface via said adhesive material to cover essentially the entire base back surface; and F) an opening defined through said base beneath said zipper mechanism, said opening including a first end located adjacent to said zipper mechanism first end, a second end located adjacent to said zipper mechanism second end, said border completely surrounding said opening on all peripheral locations of said opening.

2. The unitary zipper attachment assembly defined in claim 1 wherein said zipper mechanism includes one set of chain-forming teeth extending along and spaced from each base side edge, a slide for releasably connecting together corresponding zipper teeth of each set of chain-forming teeth, two pull tabs on said slide, one pull tab being located adjacent to said base front surface and another pull tab being located adjacent to said base back surface, a portion of said zipper mechanism extending through said base for connecting said one pull tab to said another pull tab.

3. The unitary zipper attachment assembly defined in claim 2 wherein said zipper mechanism is a two-way zipper.

4. The unitary zipper attachment assembly defined in claim 3 further including a lock assembly on one tab of said zipper pull tabs.

5. The unitary zipper attachment assembly defined in claim 4 wherein said lock assembly includes a chain connected at one end thereof to said one tab and a pull ring attached to the chain at another end of said chain.

6. The unitary zipper attachment assembly defined in claim 1 wherein said zipper sides space said zipper mechanism above said base front surface.

* * * * *